US006481441B1

(12) United States Patent
Cunningham

(10) Patent No.: US 6,481,441 B1
(45) Date of Patent: Nov. 19, 2002

(54) APPARATUS AND PROCESS FOR THRESHING TOBACCO

(75) Inventor: William Cunningham, Bristol (GB)

(73) Assignee: Imperial Tobacco Limited (GB)

( * ) Notice: Subject to any disclaimer, the term of this patent is extended or adjusted under 35 U.S.C. 154(b) by 0 days.

(21) Appl. No.: 09/319,986

(22) PCT Filed: Dec. 12, 1997

(86) PCT No.: PCT/GB97/03432

§ 371 (c)(1),
(2), (4) Date: Sep. 14, 1999

(87) PCT Pub. No.: WO98/26677

PCT Pub. Date: Jun. 25, 1999

(30) Foreign Application Priority Data

Dec. 17, 1996 (EP) ..... 96309198

(51) Int. Cl.[7] ..... A24B 5/06; A24B 5/00

(52) U.S. Cl. ..... 131/319; 131/313; 241/159; 241/190

(58) Field of Search ..... 131/311, 312, 131/313, 319, 314; 241/154, 159, 189.1, 227, 190, 191, 186.2, 195

(56) References Cited

U.S. PATENT DOCUMENTS 3,706,314 A * 12/1972 Smith, Jr. ..... 131/312
4,805,643 A * 2/1989 Tetaka ..... 131/311

FOREIGN PATENT DOCUMENTS

GB 1396931 * 6/1975

* cited by examiner

*Primary Examiner*—Steven P. Griffin
*Assistant Examiner*—Dionne A. Walls
(74) *Attorney, Agent, or Firm*—Larson & Taylor, PLC

(57) ABSTRACT

An apparatus for threshing tobacco includes a rotatable stripper and a feeder which includes a pair of cooperating counter-rotatable elements for delivering tobacco leaves to the stripper. The feeder and the stripper are arranged such that, in use, the tobacco leaves experience shearing forces as they pass from between the counter-rotating elements to the rotating stripper. These forces at least partially strip the lamina from the stems.

14 Claims, 5 Drawing Sheets

APPARATUS AND PROCESS FOR THRESHING TOBACCO

This invention relates to apparatus and a process for threshing tobacco.

In the tobacco industry, it is well-known that in order to process the tobacco into a suitable form for use in the manufacturing of products, the tobacco leaf has to have the midrib stem removed from the rest of the tobacco leaf. This separation is sometimes done by hand but is more commonly done using a threshing machine.

Threshing machines for tobacco, now in use, differ little from that described by Du Brul in U.S. Pat. No. 209,801 of Nov. 12, 1878, designed for threshing tobacco for use as cigar filler.

In the current art, the most common leaf threshing process consists of:

1. Feeding the tobacco leaves into the top of a threshing mill. The leaves are broken up by the action of a rotating element, with radially protruding teeth, until they are small enough to pass through a fixed screen at the bottom of the mill.
2. The threshed leaf is then classified using an air flow in a vertical tower. The lighter, stem free, material rises with the air flow and is removed from the threshing process. The heavier, stem containing, material drops, under the influence of gravity, down the tower, through the air.
3. This heavy, stem containing material is passed to a second threshing mill, and the process is repeated.

The overall threshing process usually has between 4 and 6 stages of threshing and classifying before all the lamina is removed from the midrib stem.

The most common form of-threshing mill for tobacco is described by Allen in U.S. Pat. No. 2,760,492 and Bonner et al in U.S. Pat. No. 3,141,485.

U.S. Pat. No. 2,962,029 (McCashen) describes a tobacco threshing machine having a single rotating threshing element mounted inside a rotating drum.

Various documents describe machines which include two or more rotating threshing elements inside a single machine with various claims for improvements over existing single rotor threshers. Bonner et al in U.S. Pat. Nos. 3,126,014 and 3,696,817 describe a thresher containing two or more rotating elements in a cascade, set in conventional fixed baskets. Smith in U.S. Pat. No. 3,706,314 describes a machine with two rotating elements with radial teeth meshing with rotating elements consisting of discs. None of these three machines is in common use.

Wochnowski in GB 1,077,410 and Johansson et al in U.S. Pat. No. 3,229,698 describe threshers containing two or more mills with fixed baskets contained within an air separation tower. In the first of these, the threshers are conventional in form. In the second, the thresher axis is mounted vertically rather than horizontally. Machines of the second form are commercially used but they seem generally to be less efficient than the conventional type and are used primarily where floor space is at a premium.

Phillips in GB 301,239 describes a machine for stripping tobacco leaves in which the lamina is separated from the stem by passing the leaves between pairs of counter-rotating brushes and rollers which rotate at different speeds. The leaves are subjected to tensile forces which separate the-lamina from the stem.

Dahistrom et al in U.S. Pat. No. 2,150,493 and U.S. Pat. No. 2,152,791 teach a device for disintegrating tobacco leaves which includes a pair of counter-rotating rollers for feeding tobacco leaves to a rotating cylinder having a series of projecting teeth. However, all of the separation of the lamina from the stem occurs away from the rollers at the point where the teeth on the cylinder pass through a series of intermeshing discs.

U.S. Pat. No. 2,789,564 (Hunter) and U.S. Pat. No. 4,805,643 (Tetaka) describe apparatus in which tobacco is delivered to a relatively large toothed rotor via an opening located. above the rotor. Hunter employs further smaller toothed rotors which intermesh with the large rotor to thresh the tobacco leaves.

EP-A-0135048 relates to a system for use with a tobacco threshing machine to control lamina size.

In the food and farming industries, threshing is traditionally used to obtain the seeds or fruits of the crop free from the bulk of the plant material. This is normally done as a part of the harvesting.

Threshers used for legume crops use an axial flow threshing system as described by Looker et al in GB 1,396,931 and 1,396,932. Here the crop mass is transferred into a large rotary drum constructed from mesh panels. Inside the drum are a number of beater elements.

According to Looker et al, these work by designing the crop mass flow path such that several impacts occur. These impacts are sufficient to break open the legume pod and free the seeds contained inside.

The present invention relates to apparatus and a process for threshing tobacco which has significant advantages over the known techniques.

Accordingly, the present invention provides apparatus for threshing tobacco comprising rotatable stripping means and a feeder comprising a pair of co-operating counter-rotatable elements for delivering tobacco leaves to the stripping means, the feeder and the stripping means being arranged such that, in use, the tobacco leaves experience shearing forces as they pass from between the counter-rotating elements to the rotating stripping means which forces at least partially strip the lamina from the stem.

The stripping means preferably comprises radially extending arms. The arms may be in the form of continuous plates or spaced teeth (which can be straight, bent or curved) and may include parts which are capable of cutting the tobacco leaves or are capable of puncturing the leaf and tearing through the leaf.

The elements also preferably comprise radially extending arms which also may be in the form of straight, curved or bent continuous plates or spaced teeth, optionally including parts which are capable of cutting the tobacco leaves. Alternatively, the feeder elements may comprise a pair of rollers or may consist of a flexible membrane wrapped around a framework which allows variable quantities of leaf to be fed.

The arms may be flexible, inflexible or a mixture of fixed and flexible components.

The rotating elements and the stripping means can take the same form and may be the same shape and size, differing only in their function which is dictated by their position in the apparatus.

The stripping means and the feeder are arranged at a relatively close distance from each other in order to subject the tobacco to the shearing forces which at least partially strip the lamina from the stem. Preferably, the distance between the outermost parts of the two elements in the feeder is less than 150 mm and the distance between the outermost parts of each of these elements and the outermost parts of the stripping means is less than 100 mm. The shearing forces are experienced by the tobacco leaves as they are directed from the feeder to the rotating stripping means. The tobacco leaves are preferably delivered to the rotating stripping means substantially along a radius of the axis of rotation of the stripping means. The lamina is stripped from the stem in the region where the leaves pass from being moved under the influence of the feeder to being moved by the stripping means and, as the skilled person will appreciate, the exact position of this region will vary depending upon the particular configuration of the apparatus and the rate of rotation of its various rotating components. The shearing force can be considered, at least in certain circumstances, as arising from the action of the stripping means on one part of the leaf while the feeder is holding another part of the leaf.

Preferably, where the arms of the stripping means and those of the elements consist of spaced teeth, the teeth are intermeshed. With such an arrangement, the stripping of the lamina from the stem is effected, to some extent, by the interaction of the stripping means and the feeder. When the teeth are intermeshed, the distance between the teeth as they pass each other is typically less than 100 mm.

The apparatus preferably comprises a rotatable drum in which the stripping means and the feeder are arranged. The drum may be generally cylindrical and its walls may be solid. However, the drum preferably comprises a screen (e.g., in its walls) which allows at least a part of the stripped tobacco to pass out of the drum. The screen can form all or only part of the side walls of the drum.

The drum preferably incorporates internally protruding lugs for directing the tobacco leaves to the feeder elements. As the drum rotates, the lugs collect the tobacco leaves so that the leaves travel around the inside of the drum until they fall (preferably solely under the influence of gravity) into the feeder. The positioning of the feeder within the drum and/or the speed of rotation of the drum are adjusted so as to ensure that a suitable amount of the tobacco leaves is delivered to the feeder as the drum rotates.

To assist transfer through the drum, an additional fixed or rotating element, running down the drum parallel to the stripping means, may be used to slow down the tobacco leaving the stripping means. The tobacco thus slowed will then be able to fall under the influence of gravity onto a lower portion of the surface of the drum. Preferably the tangential speed of the additional rotating element is similar to that of the drum (i.e., ±50% of the speed of the drum) and it is also preferred that the additional rotating element has a direction of rotation opposite to that of the drum.

The stripping means and the elements preferably rotate about axes which are parallel to the axis of rotation of the drum. Preferably, the axes of rotation are either substantially horizontal or are tilted at from 0° to 10° (more preferably from 2° to 6°) to the horizontal.

The stripping means and elements can converge as they approach the exit end of the drum to take account of reduced loading resulting from the small particles being sieved out of the main flow. This also allows the amount of threshing that takes place to increase towards the exit end of the drum. This convergence can be achieved by varying the diameter of the stripping means and/or the elements along their length. By adopting this method, an additional effect will be to increase the tangential velocity of the arm tips as the diameter increases and this will affect the threshing characteristics.

The diameter of the drum will typically be in the range of from 300 to 2500 mm, preferably from 900 to 1800 mm.

The diameters of the stripping means and the elements (as defined by the end of any radially protruding arms) are typically from 5 to 50% of the diameter of the drum.

The tangential velocity of the drum is preferably in the range of from 0.04 to 0.5 m/s with the tangential velocity of the stripping means and the elements being from 3 to 250 times (preferably 10 to 100 times) greater than that of the drum.

The rotating components of the apparatus (other than the drum) can be run at synchronous speeds to achieve true intermeshing of the stripping means and the rotating elements. Alternatively, the rotating components can be run such that they have different tangential velocities, thus setting up shear actions between the various rotating components. The choice of rotational speed and mode of operation depend upon the design of the rotating component and drum protrusions used and this in turn depends on the nature of the leaves being threshed and upon the required specification of the threshed material.

The conveyer used for feeding the leaf material into the drum can be constructed such that it will move the feed point of the leaves into the drum. This can be used to control the amount of threshing that is done on the leaves.

An open topped conveying device can also be incorporated to remove large pieces of free lamina from the rest of the leaf material. The action of the rotating components of the apparatus can be arranged to throw the leaf material through the air. The lighter stem free lamina slows down more rapidly and lands on the conveyer while the heavier stem containing parts are thrown over the top of the conveyor and continue around the drum for further threshing. This avoids unnecessary damage to the larger pieces of stem free lamina.

Directed air currents within the drum could be used to assist this separation.

In another embodiment, the present invention relates to a process for threshing tobacco which comprises providing tobacco leaves to a feeder comprising a pair of co-operating counter-rotating elements and feeding the leaves from the feeder to rotating stripping means such that the leaves experience shearing forces as they pass from between the counter-rotating elements to the stripping means which forces at least partially strip the lamina from the stem. The process is conveniently carried out using the apparatus of the invention.

The tobacco leaves which are threshed in the apparatus and process of the invention preferably have a moisture content of between 5 and 35% by weight and may have been conditioned before threshing.

The apparatus of the invention can comprise more than one (e.g., two) stripping means and the extra stripping means can be provided by one or more additional rotating elements. These additional elements may carry out a degree of threshing and/or cutting of the tobacco leaves and they may participate in the delivery of the partially threshed or unthreshed leaves to the feeder and/or the stripping means. The apparatus may also comprise additional rotating elements which act solely to direct leaf material into the stripping means.

The invention will now be described, by way of example only, with reference to the accompanying drawings, wherein.

Figure 1:
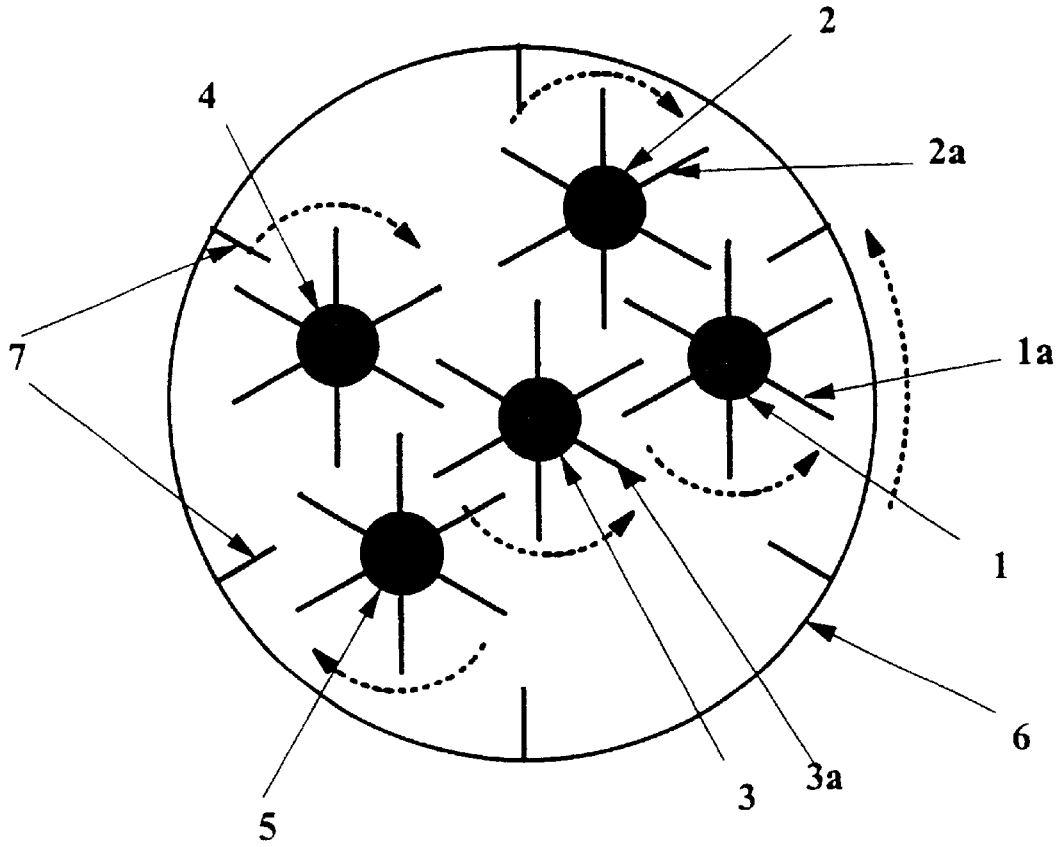
FIG. 1 shows a cross-section through an apparatus according to one embodiment of the invention.
Figure 5:
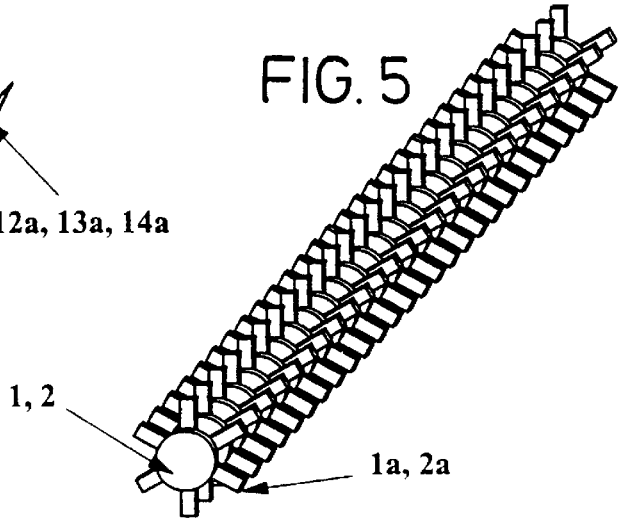

Referring to FIG. 1, drum 6 rotates about a substantially horizontal axis in an anti-clockwise direction. A series of lifting pins (or lugs) 7 are attached to the inside surface of drum 6. The function of the pins 7 is to move the tobacco leaves up the side of drum 6. The leaves are then gathered by co-operating counter-rotating elements 1 and 2 which form a feeder for the leaves. Elements 1, 2 comprise radially extending arms 1*a*, 2*a* which run the full length of the drum. In the embodiment of the invention shown in FIG. 1, the arms 1*a*, 2*a* are as depicted in FIG. 5. The leaves are forced between elements 1,2 where some of the shearing or cutting of the leaves may take place. The leaves are delivered from between elements 1,2 into stripping means 3 which has arms 3*a*. Stripping means 3 rotates in the same direction as the drum in the Figure, i.e., anti-clockwise, although it may rotate in the opposite direction. It is in the region of delivery of the leaves from elements 1,2 to arms 3*a* of stripping means 3 that the major part of the threshing takes place as the leaves which are still partially held by elements 1,2 are torn by the shearing action of stripping means 3. Stripping means 3 may also act to cut the leaves to some extent. The leaves threshed by stripping means 3, excluding any parts of the threshed leaf which may have fallen t the bottom of drum 6, are gathered between stripping means 3 and element 4 which is located further round the drum 6 (in the direction of its rotation) and are forced towards second stripping means 5 creating a second shearing zone within the drum. The rotational direction of the rotating elements 1,2,4, the stripping means 3,5 and the drum 6 are indicated by the broken arrows.

Figure 2:
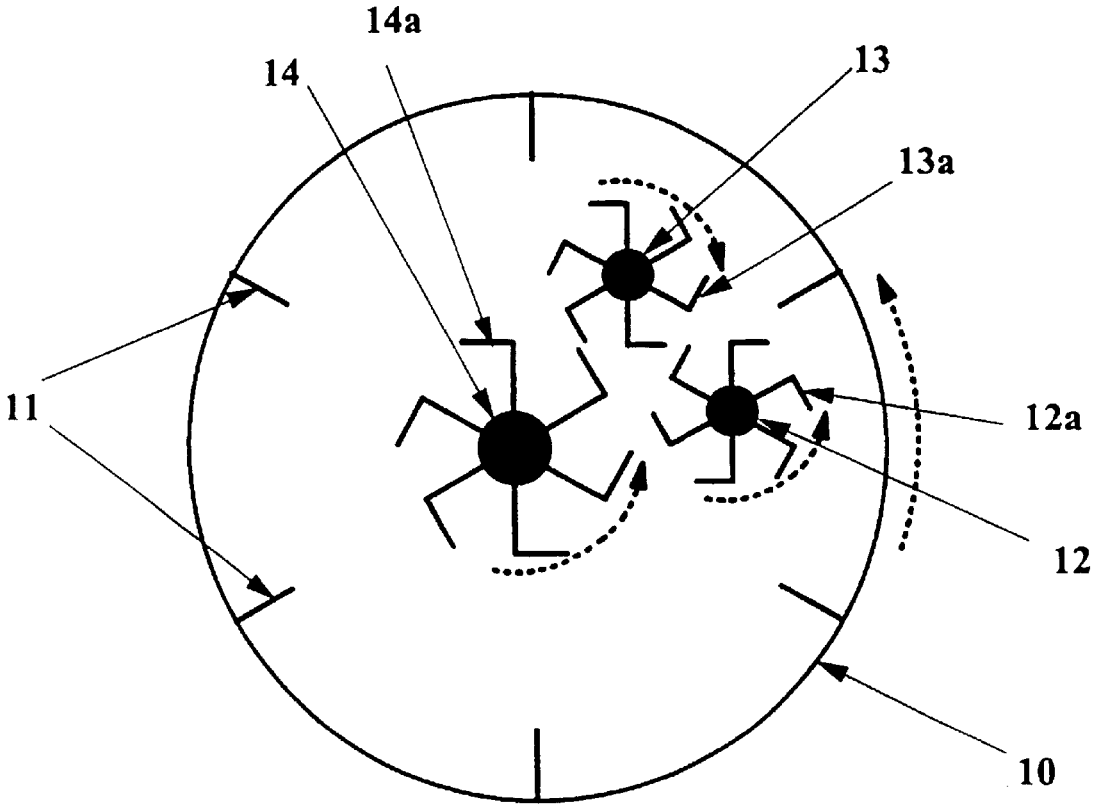
FIG. 2 shows a cross-section through an apparatus according to another embodiment of the invention.
Figure 7:
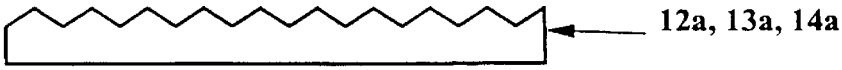
FIG. 7 shows a plan view of another arm for use in the stripping means of the invention.

Another embodiment of the invention is illustrated in FIG. 2. Here the leaves are carried up the side of the drum 10 on the lugs 11 by the rotational movement of the drum 10 (anti-clockwise in the Figure). The leaves are then drawn into the gap between the counter-rotating elements 12 and 13 which run the length of the drum 10 and co-operate to act as a feeder which directs the leaves into stripping means 14. The main function of stripping means 14 is to shear or rip the lamina free from the stems of the leaves. Stripping means 14 and elements 12,13 have bent arms 14*a*,12*a*,13*a* and are of the general design shown in FIG. 4. An alternative design for the arms 14*a*, 12*a*, 13*a* is illustrated in FIG. 7.

Figure 3:
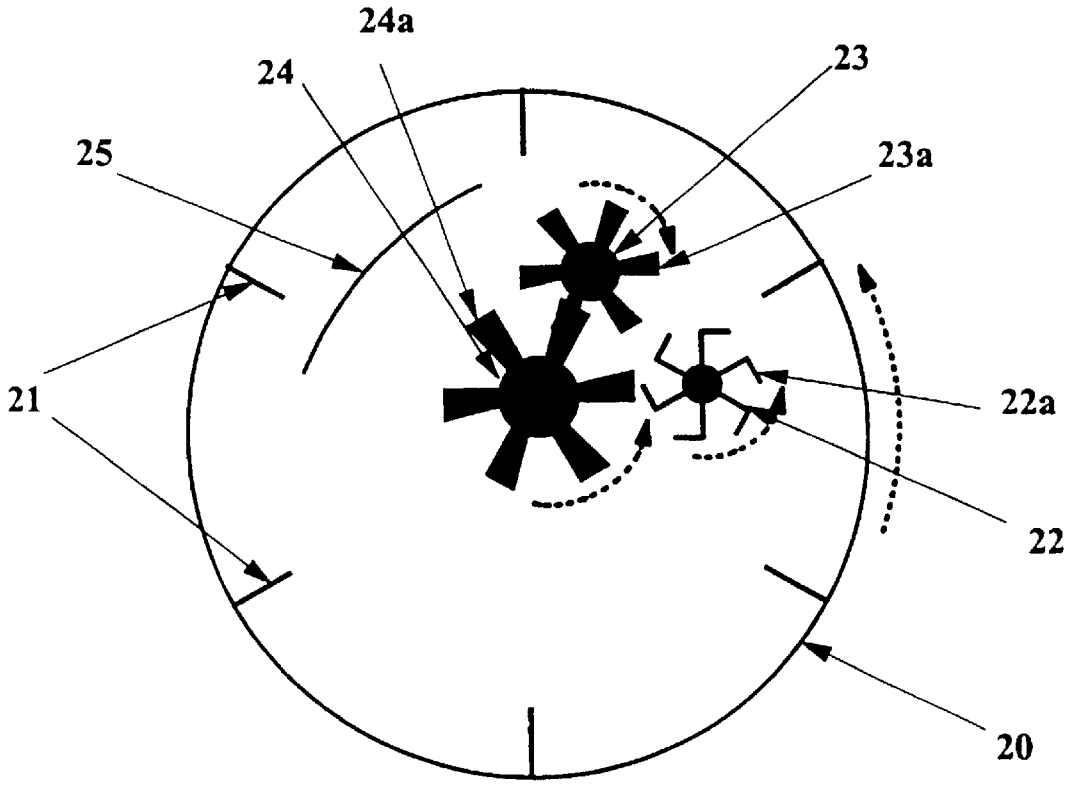
FIG. 3 shows a cross-section through an apparatus according to yet another embodiment of the invention.

In FIG. 3, drum 20 rotates anti-clockwise and, in use, lugs 21 transfer tobacco leaves to counter-rotating elements 22 and 23. The differently designed arms 22*a* and 23*a* of elements 22 and 23, respectively, feed the leaves to stripping means 24 which has arms 24*a*. Arms 24*a* intermesh with arms 23*a*. Fixed element 25 catches the threshed tobacco as it leaves stripping means 24 and allows it to fall back down to the inside surface of drum 20.

Figure 6:
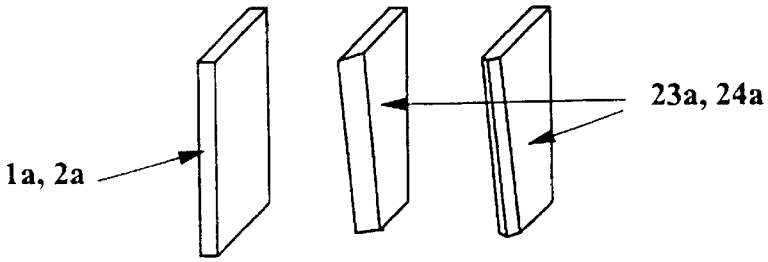
FIG. 6 shows perspective views of three types of arm (or teeth) for use in the apparatus of the invention.

Referring to FIG. 6, the arms 1*a*, 2*a* of the feeder and/or the stripping means may have a flat edge. Alternatively, as shown for arms 23*a*, 24*a*, the outermost edge of the arms may be tapered to a point and may taper from one end to a narrower other end along the drum direction in order to assist in the shearing of the leaves.

Figure 8:
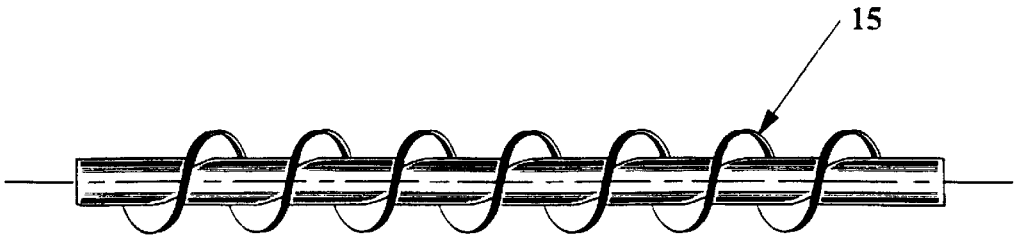
FIG. 8 is a side view of yet another stripping means suitable for use in the apparatus of the invention.

The process of the invention may be run continuously or as a batch process. For continuous operation, the tobacco leaves are fed into one end of the drum, the leaves are threshed throughout the length of the drum and the threshed leaves which have not already passed out of the drum (e.g., through screens in its walls) exit the drum at the other end. Passage of the leaves from one end of the drum to the other can be achieved by tilting the drum and, optionally, also the rotating components of the apparatus at an angle to the horizontal or by including a helical screw 15 in the apparatus, as shown in FIG. 8. The helical screw can constitute the stripping means and/or the rotating elements of the apparatus.

Alternatively, the transfer of the leaf material down the drum can be effected by arranging the lugs helically on the inside of the drum or the transfer can be caused by air currents acting on the leaf material.

Figure 9:
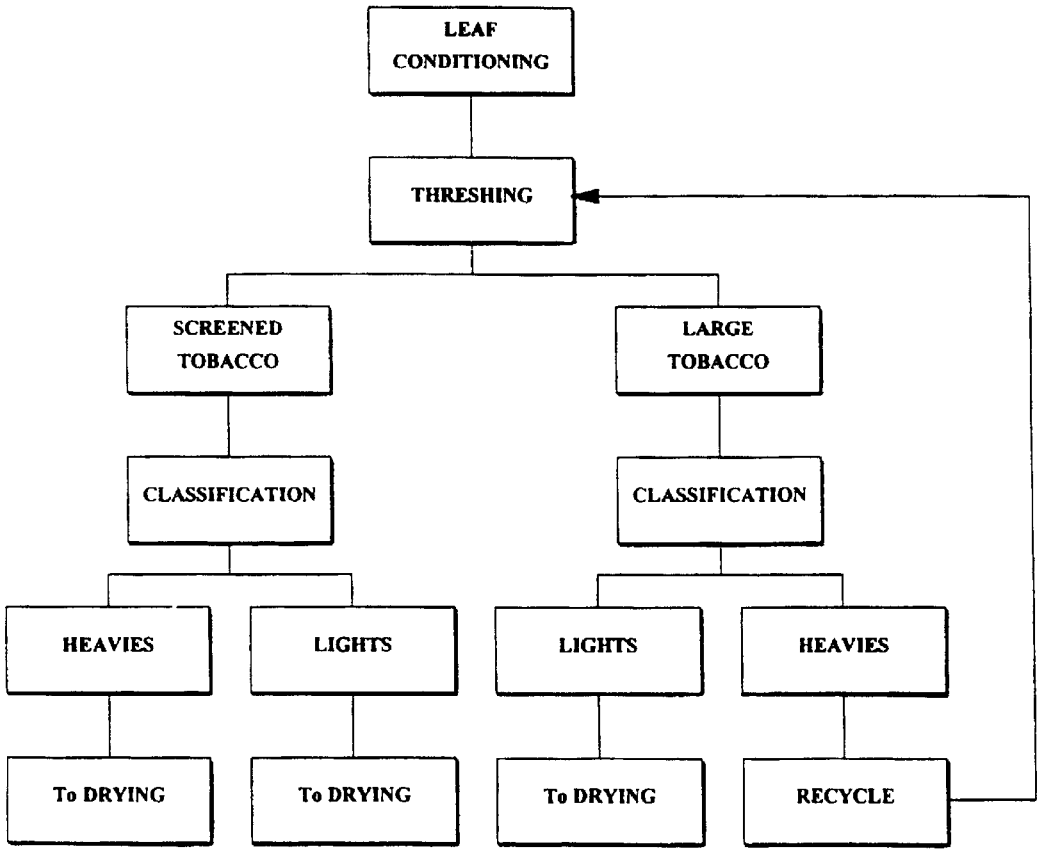
FIG. 9 is a flow diagram of a preferred process for threshing tobacco using the invention.

A preferred process for use with the invention involves recycling the threshed tobacco as shown in the flow chart of FIG. 9. Where the drum is constructed from screen sections, the whole device acts like a thresher and sieve in a single machine. In this way it can be incorporated into an overall process as shown in FIG. 9 or it can be used as a part of a conventional process line. With reference to FIG. 9, tobacco leaves are first conditioned and are then threshed using the process and apparatus of the invention. Two fractions are obtained after threshing; (i) screened tobacco which is the smaller pieces of threshed tobacco which have passed through a screen (preferably in the side wall of a drum of the-apparatus) and (ii) large tobacco which is the larger pieces of tobacco retained in the apparatus. The screened tobacco, made up of the smaller particles of the threshed leaves, is subjected to conventional air separation and the "heavies" and "lights" fractions go on to drying or further processing in the conventional manner. The large tobacco pieces are also subjected to air separation and the lights sent on to drying or further processing. However, the heavies are directed back to the threshing stage of the process to separate more of the lamina from the stem. This type of process is described in detail in our related European patent application no. 96309188.9 which was filed on the same day as this application and has the title "Method And Apparatus For Processing Tobacco".

As mentioned above, the surface of the drum used in the apparatus of the invention, which is preferably cylindrical, can be either solid or may comprise screens.

Where the drum surface is solid, the whole mass of leaves travels the full length of the drum passing through the stripping means.

Where the drum surface consists of screens, smaller threshed leaf particles pass out of the drum without having to traverse the full length of the drum. This means that the smaller particles will avoid further unnecessary impacts and will suffer less damage as a result once they have been threshed. Larger particles unable to pass through the screens travel the full length of the drum and exit from the end of the drum. The screens have a mesh size suited to the requirements of the desired final product.

Where the process requires an improved screening efficiency, the length of the-elements and the stripping means can be less than the full length of the drum. This allows extra screening to be carried out before, after or before and after the threshing zone by suitable location of the elements and stripping means within the drum. Stem free lamina can therefore be removed prior to threshing, eliminating unnecessary damage to it and the amount of clean stem being removed through the screen after threshing can be increased.

The apparatus, where the drum surface consists of screens, can be used to thresh filler for use in cigars. The filler which is small enough to be used in the manufacture of cigar rods will pass through the screen of the drum. The oversize material will be recycled back into the feed end of the drum, as shown in FIG. 8, and rethreshed until it is small enough to pass through the screens.

The following non-limiting examples further illustrate the invention.

EXAMPLE 1

Figure 4:
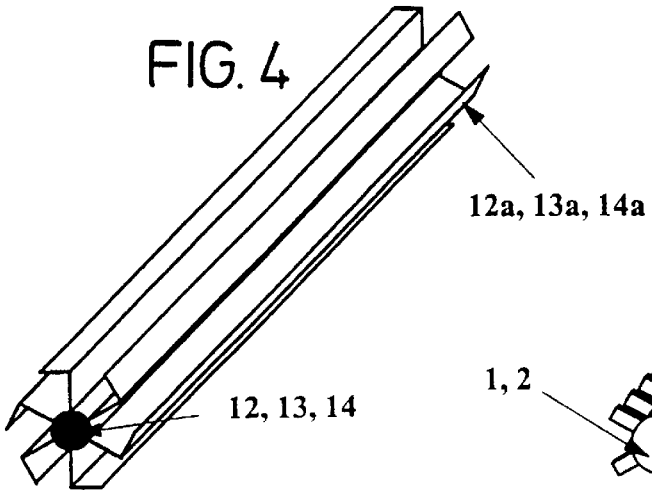
FIGS. 4 and 5 show perspective views of stripping means suitable for use in the apparatus of the invention.

A sample of tangled tobacco leaf, with a moisture content of 27.8% by weight, was threshed for 80 seconds in a batch in a machine configured as shown in FIG. 2. The tangential velocity of the drum was 0.1 8 m/s. The stripping elements, with arms as shown in FIG. 7, were rotating with a tangential velocity of 1.5 m/s and the feeding elements with arms as shown in FIG. 4, were rotating with a tangential velocity of 1.0 m/s.

The machine had a drum of diameter 1524 mm, the diameter of the stripping means (including its arms) was 455 mm and that of each of the elements of the feeder (including arms) was 305 mm. The gap between the arms of the elements of the feeder was about 100 mm and the edge of the arms of the stripping means was located about 20 mm away from the arms of the feeder elements. 60.3% of the total lamina input was removed as lamina free from stem, and the lamina contained 83% greater than 12.7 mm (½") and 6% smaller than 6.35 mm (¼").

EXAMPLE 2

A sample of tangled tobacco leaf, with a moisture content of 27.2% by weight, was threshed for 30 seconds in a batch in the machine described in Example 1. The tangential velocity of the drum was 0.17 m/s. The stripping elements, with arms as shown in FIG. 7, were rotating with a tangential velocity of 3.0 m/s and the feeding elements with arms as shown in FIG. 4, were rotating with a tangential velocity of 2.0 m/s. 73.6% of the total lamina input was removed as lamina free from stem, and the lamina contained 88.2% greater than 12.7 mm (½") and 3.3% smaller than 6.35 mm (¼").

EXAMPLE 3

A sample of tangled tobacco leaf, with a moisture content of 20.7% by weight, was threshed for 20 seconds in a batch in the machine described in Example 1. The tangential velocity of the drum was 0.17 m/s. The stripping elements, with arms as shown in FIG. 4, were rotating with a tangential velocity of 2.95 m/s and the feeding elements with arms as shown in FIG. 1, were rotating with a tangential velocity of 1.97 m/s. 75.9% of the total lamina input was removed as lamina free from stem, and the lamina contained 87.5% greater than 12.7 mm (½") and 3.9% smaller than 6.35 mm (¼").

EXAMPLE 4

A sample of tangled tobacco leaf, with a moisture content of 25.2% by weight, was threshed for 20 seconds in a batch in the machine described in Example 1. The tangential velocity of the drum was 0.18 m/s. The stripping elements, with arms as shown in FIG. 7, were rotating with a tangential velocity of 3.94 m/s and the feeding elements with arms as shown in FIG. 4, were rotating with a tangential velocity of 1.53 m/s. 64.4% of the total lamina input was removed as lamina free from stem, and the lamina contained 88.5% greater than 12.7 mm (½") and 3.4% smaller than 6.35 mm (¼").

The advantages of the apparatus of the invention over conventional threshers can be summarised as follows:

(a) Larger pieces of free lamina can be produced as they do not have to be reduced in size to pass through the thresher basket.

(b) Less dust is produced from the leaves as no grinding of the leaves occurs between the thresher rotor and the surfaces of the machine.

(c) The total plant to complete the threshing of leaves is reduced as up to 90% of the lamina can be freed from the stem in a single pass, compared to less than 70% for a conventional thresher.

What is claimed is:

1. Apparatus for threshing tobacco comprising rotatable stripping means and a feeder comprising a pair of co-operating counter-rotatable elements for-delivering tobacco leaves to the stripping means, the feeder and the stripping means being arranged such that, in use, the tobacco leaves experience shearing forces as they pass from between the counter-rotating elements to the rotating stripping means which forces at least partially strip the lamina from the stem.

2. Apparatus as claimed in claim 1, wherein the stripping means comprises radially extending arms.

3. Apparatus as claimed in claim 1, wherein the elements comprise radially extending arms.

4. Apparatus as claimed in claim 1, wherein the stripping means and the feeder are arranged within a rotatable drum.

5. Apparatus as claimed in claim 4, wherein the drum comprises a screen which allows at least a part of the stripped lamina to pass out of the drum.

6. Apparatus as claimed in claim 4, wherein the drum comprises internally protruding lugs for directing the tobacco leaves to the feeder.

7. Apparatus as claimed in claim 4, wherein the stripping means and the elements rotate about axes which are parallel to the axis of rotation of the drum.

8. Apparatus as claimed in claim 7, wherein the axes of rotation are substantially horizontal.

9. Apparatus as claimed in claim 1, which comprises two rotatable stripping means.

10. Apparatus as claimed in claim 1, which further comprises means for reducing the velocity of the tobacco leaves after they exit from the stripping means.

11. Apparatus as claimed in claim 10, wherein said means for reducing the velocity of the tobacco leaves is either fixed or rotates and has its axis aligned substantially parallel to the axis of rotation of the stripping means.

12. Apparatus as claimed in claim 2, wherein the arms are in the form of plates or teeth.

13. Apparatus as claimed in claim 12, wherein the arms of the stripping means and the arms of at least one of the elements are intermeshed.

14. Apparatus as claimed in claim 2, wherein the arms are flexible.

* * * * *